US010264883B2

(12) United States Patent
Stefenack

(10) Patent No.: US 10,264,883 B2
(45) Date of Patent: Apr. 23, 2019

(54) PLATFORM MOUNTING SYSTEM AND METHOD

(71) Applicant: Ian Stefenack, Philadelphia, PA (US)

(72) Inventor: Ian Stefenack, Philadelphia, PA (US)

( * ) Notice: Subject to any disclaimer, the term of this patent is extended or adjusted under 35 U.S.C. 154(b) by 0 days.

(21) Appl. No.: 15/328,553

(22) PCT Filed: Dec. 16, 2015

(86) PCT No.: PCT/US2015/065954

§ 371 (c)(1),
(2) Date: Jan. 24, 2017

(87) PCT Pub. No.: WO2016/100426

PCT Pub. Date: Jun. 23, 2016

(65) Prior Publication Data

US 2018/0206641 A1 Jul. 26, 2018

Related U.S. Application Data

(60) Provisional application No. 62/092,454, filed on Dec. 16, 2014.

(51) Int. Cl.

| | |
|---|---|
| ***A47B 96/02*** | (2006.01) |
| ***A47B 96/06*** | (2006.01) |
| ***A47K 3/12*** | (2006.01) |

(52) U.S. Cl.

CPC ..... *A47B 96/066* (2013.01); *A47B 96/02* (2013.01); *A47B 96/022* (2013.01); *A47K 3/122* (2013.01)

(58) Field of Classification Search

CPC ... A47B 96/066; A47B 96/022; A47B 96/067; A47B 96/068; A47B 96/14; A47B 96/02; A47K 3/122; A47K 3/282; A47K 3/12; A47K 3/281

USPC ..... 248/220.1, 225.11; 211/90.02; 108/42

See application file for complete search history.

(56) References Cited

U.S. PATENT DOCUMENTS

| | | | | |
|---|---|---|---|---|
| 2,261,078 | A | 10/1941 | Shockey | |
| 2,465,635 | A * | 3/1949 | Conterio | A47B 96/022 108/42 |
| 5,477,969 | A | 12/1995 | Beeskau et al. | |
| 5,513,575 | A * | 5/1996 | Slade | A47B 96/02 108/42 |
| D395,186 | S * | 6/1998 | Pollack | D6/562 |
| 6,052,845 | A | 4/2000 | Harvey | |
| 6,467,636 | B1 * | 10/2002 | Schaefer | A47B 96/022 108/147.11 |
| 6,591,762 | B1 * | 7/2003 | Haghayegh | A47B 96/022 108/42 |
| 6,619,488 | B2 * | 9/2003 | Bengoechea | A47B 96/022 108/152 |

(Continued)

OTHER PUBLICATIONS

International Search Report and Written Opinion dated Dec. 16, 2015 in International Patent Application No. PCT/US2015/065954 (15 pages).

*Primary Examiner* — Nkeisha Smith
(74) *Attorney, Agent, or Firm* — Fox Rothschild LLP

(57) ABSTRACT

A surface platform mounting system and method. The system includes a platform and a plurality of anchoring plates. The platform defines at least one anchoring edge and at least one free edge. Each anchoring edge defines an inwardly extending channel. Each anchoring plate is configured to be secured within a respective channel and within a respective slot of the surface.

4 Claims, 6 Drawing Sheets

(56) References Cited

U.S. PATENT DOCUMENTS

| | | | | |
|---|---|---|---|---|
| 7,621,223 | B2 * | 11/2009 | Haghayegh | F16B 12/04 108/42 |
| 7,673,420 | B2 * | 3/2010 | Madesh | A47C 11/00 4/611 |
| 7,987,535 | B1 * | 8/2011 | Tesch | A47K 3/282 108/42 |
| 9,261,078 | B2 * | 2/2016 | Calley | F03D 7/0256 |
| 9,277,818 | B1 * | 3/2016 | Preston | A47B 96/022 |
| 9,402,476 | B2 * | 8/2016 | Crandall | A47B 96/022 |
| 9,439,510 | B2 * | 9/2016 | Karins, Sr. | A47B 96/06 |
| 9,526,337 | B2 * | 12/2016 | Karins, Sr. | A47B 96/06 |
| 2006/0156637 | A1 * | 7/2006 | Blankenship | A47K 3/281 52/34 |
| 2008/0224004 | A1 * | 9/2008 | Gallien | A47B 96/022 248/220.1 |
| 2009/0224119 | A1 * | 9/2009 | Heffernan | A47B 96/066 248/225.11 |
| 2017/0130895 | A1 * | 5/2017 | Sisto | F16M 13/025 |

* cited by examiner

PLATFORM MOUNTING SYSTEM AND METHOD

This application is a national phase application of International Patent Application No. PCT/US15/65954 filed Dec. 16, 2015, which application claims the benefit of US Provisional Application No. 62/092,454, filed on Dec. 16, 2014, the contents of which are incorporated herein by reference.

FIELD OF THE INVENTION

This disclosure relates to platforms utilized as shelves, seats and the like. More particularly, the disclosure relates to a system and method for mounting a platform along a surface.

BACKGROUND OF THE INVENTION

Platforms are often installed in bathroom showers and the like and are utilized as shelves, seats or other support surfaces. The platforms may be manufactured from natural and synthetic materials, for example, stone, porcelain and ceramic tile. Typically, the platform is selected before installation of the bathroom tiles and the edges of the platform are mortared into place during the tiling process. Since the platform is occupying the space where the next row of tile would normally be placed, the tiles need to be cut accommodate the platform and maintain the consistency of the tile rows.

Often times it is decided to add a platform shelf or seat into the shower after the tiling is complete. Such a retro-fit installation can be difficult, requiring removal or cutting of the existing wall tiles. Alternatively, the platform is secured using adhesive strips, adhesive caulk or the like, however, because the platform is subjected to sheer and torque forces along the wall, the adhesives frequently fail after some time.

SUMMARY OF THE INVENTION

In at least one embodiment, the present disclosure provides a surface platform mounting system. The system includes a platform and a plurality of anchoring plates. The platform defines at least one anchoring edge and at least one free edge. Each anchoring edge defines an inwardly extending channel. Each anchoring plate is configured to be secured within a respective channel and within a slot of a surface.

In at least one embodiment, the present disclosure provides a method of securing a platform relative to a surface. The method includes securing a plurality of anchoring plates in respective slots in the surface such that at least a portion of each anchoring plate extends from the surface; sliding at least one channel defined along at least one anchoring edge of the platform over the portions of anchoring plates extending from the surface; and securing each anchoring plate within the respective channel. In at least one embodiment, the slot is defined by a joint between two tiles secured to the surface.

BRIEF DESCRIPTION OF THE DRAWINGS

The accompanying drawings, which are incorporated herein and constitute part of this specification, illustrate the embodiments of the invention, and, together with the general description given above and the detailed description given below, serve to explain the features of the system and method. In the drawings.

DETAILED DESCRIPTION OF THE INVENTION

Figure 1:
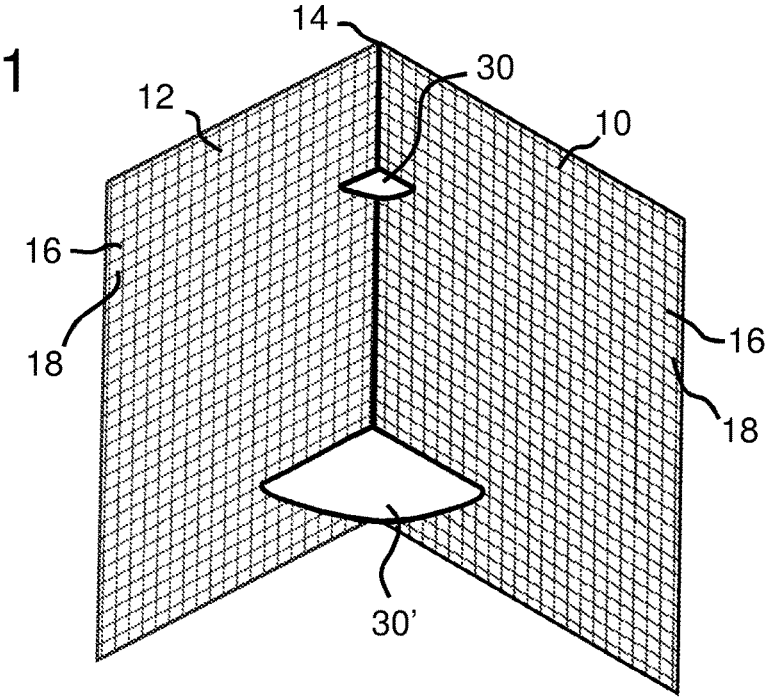
FIG. 1 is a perspective view of a portion of a shower incorporating a shelf platform and a seat platform in accordance with embodiments of the invention.

In the drawings, like numerals indicate like elements throughout. Certain terminology is used herein for convenience only and is not to be taken as a limitation on the present invention. It should be understood, based on this disclosure, that the invention is not limited by the embodiments described herein.

Referring to FIG. 1, a portion of a shower incorporating a shelf platform system 30 and a seat platform system 30' in accordance with embodiments of the invention will be described. The shower includes adjacent walls 10 and 12 which meet at a corner 14. Each wall 10, 12 includes tiles 16 formed in rows with grout joints 18 between the rows. While an exemplary shower is described herein, the invention is not limited to such. The systems and methods described herein can be used on any surfaces, whether tiled or not and whether in a shower, other area of the bathroom, in a kitchen or any other surfaces. In the illustrated embodiment, each platform system 30, 30' is positioned along one of the horizontal joints 18, as will be described in more detail hereinafter. However, it is recognized that the platform system 30, 30' may be positioned along a surface without joints or in a position not aligned with a joint.

Figure 2:
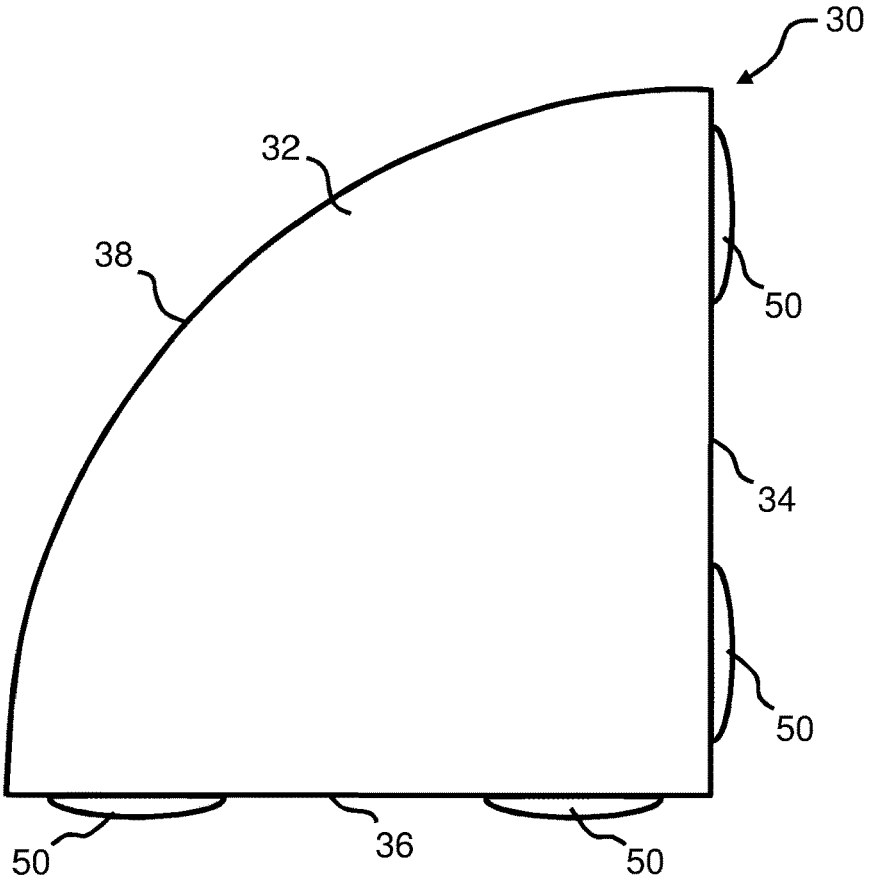
FIG. 2 is a top plan view of a platform system in accordance with an embodiment of the disclosure.
Figure 3:
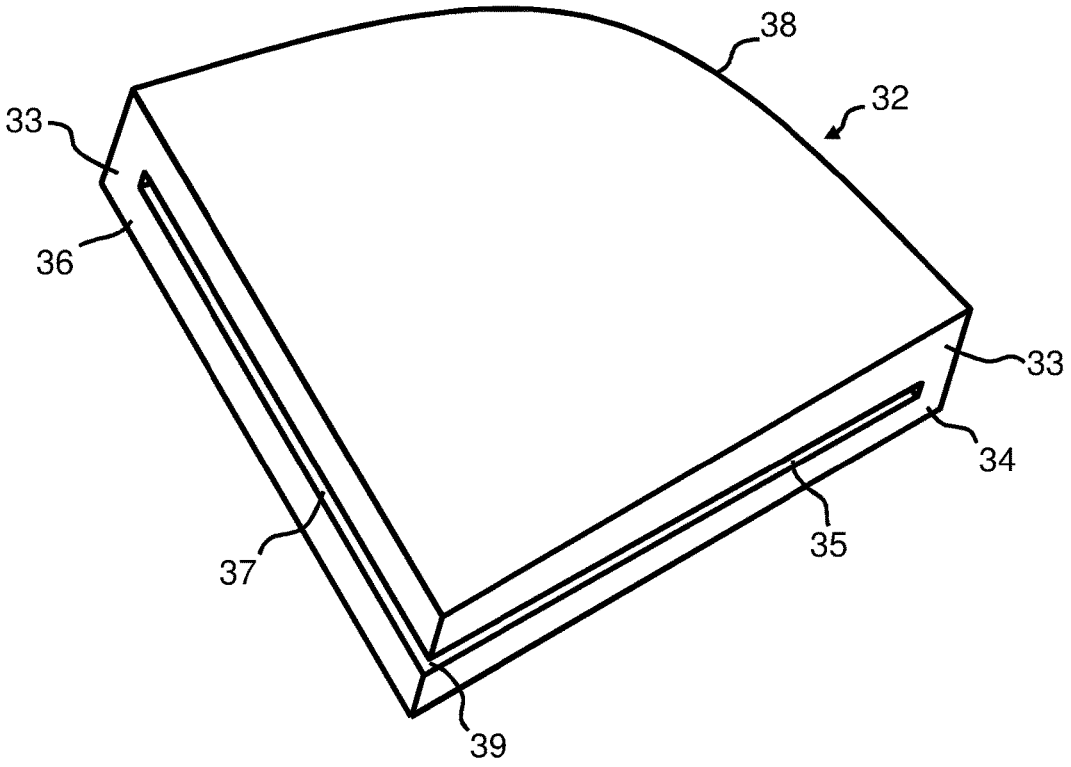
FIG. 3 is rear perspective view of a platform in accordance with an embodiment of the disclosure.
Figure 4:
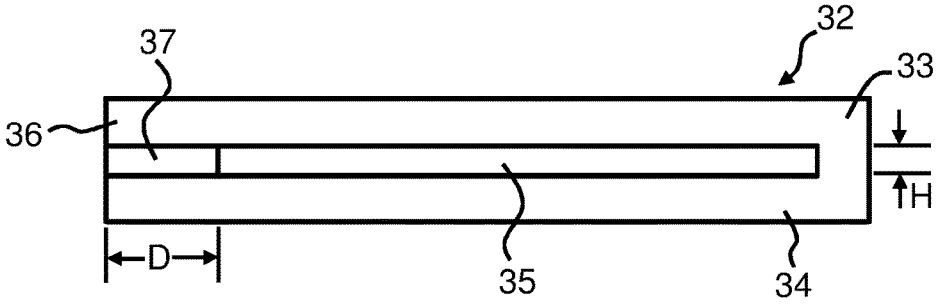
FIG. 4 is a side elevation view of the platform of FIG. 3.

Referring to FIGS. 2-4, the platform systems 30, 30' generally include a platform 32 and a plurality of anchoring plates 50. The platform systems 30 and 30' are substantially the same except for the size of the platform 32 and the number of anchoring plates 50 utilized. As such, only the platform system 30 will be described in detail below.

The illustrated platform 32 includes a body with anchoring edges 34 and 36 with a free edge 38 extending therebetween. The illustrated platform 32 is intended to be positioned in a corner 14 and therefore includes the anchoring edges 34, 36 at a right angle. The free edge 38 is illustrated as a rounded surface, but may have additional configurations. Additionally, the platform 32 may be configured for installation in an area other than a corner whereby the platform 32 may include more or less than two anchoring edges 32, 34 and they may be at angles other than 90°. For example, the platform may be configured for mounting along a planar wall wherein the platform will only include one anchoring edge. The remaining edges will define free edges.

Referring to FIGS. 3 and 4, a channel 35, 37 is defined along each anchoring edge 34, 36. In the illustrated embodiment, the channels 35, 37 intersect at area 39 in the corner of the platform 32, however, such intersection may not be necessary. Each channel 35, 37 has a depth D which is at least as large as half the width W of the anchoring plates 50 (see FIG. 6), however, the depth D may be larger than the width W to provide flexibility of the system. As one example, the channels 35, 37 may have a depth D of approximately 1 to 1½ inches. Similarly, each channel 35, 37 has a height H which is slightly larger than the thickness T of the anchoring plates 50. As one example, the channels 35, 37 may have a height H of approximately 1/16 to 3/32 of an inch. The channels 35, 37 extend along a substantial portion of the anchoring edge 34, 36, however, terminate a distance from the free edge 38 such that a solid portion 33 extends between the channel 35, 37 and the free edge 38. With such configuration, the free edge 38 remains unblemished and the channels 35, 37 are not visible upon mounting of the platform 32 (see FIG. 12).

The channels 35, 37 may be formed into the anchoring edges 34, 36 during manufacture of the platform 32 or after manufacturing. To form the channels 35, 37 after manufacturing, a standard platform may be utilized and a tile saw or the like used to form the channels 35, 37.

Figure 5:
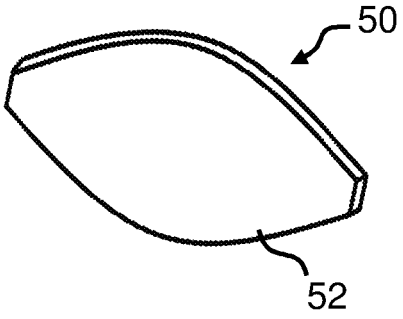
FIG. 5 is a perspective view of an anchoring plate in accordance with an embodiment of the disclosure.
Figure 6:
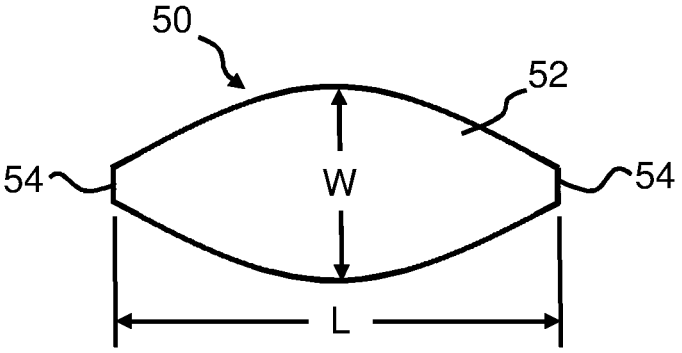
FIG. 6 is a front elevation view of the anchoring plate of FIG. 5.
Figure 7:
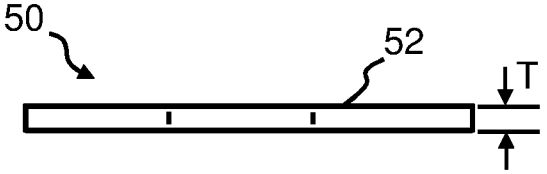
FIG. 7 is a top plan view of the anchoring plate of FIG. 5.

Referring to FIGS. 5-7, each anchoring plate 50 has a solid body 52 which has a substantially elliptical shape with narrow ends 54 and a wider central region 56. While an elliptical shape is shown, the anchoring plates may have other configurations, for example, rectangular. The central region 56 defines the maximum width W of the anchoring plate 50. The width W may vary depending on the thickness of the tile 16 or other characteristics of the surface to which the platform 32 is to be mounted, however, the depth D of the channels 35, 37 allow for a standard width W which can be used with tiles 16 of varying thickness. As an example, the anchoring plate body 52 may have a width W of approximately 1 inch. The body 52 has a length L which is larger than the width W thereof. For example, the ratio of the length L to the width W may be approximately 1.5:1 to 3:1. As an example, the anchoring plate body 52 may have a length L of approximately 2⅜ inches. The anchoring plates 50 have a thickness T configured to fit within the joint 18 between the tiles 16. As an example, the anchoring plate body 52 may have a thickness T of approximately 0.06 inches, which is less than the typically smallest tile joint 18 of 1/16 of an inch.

Having described the general components of the platform system 30, a method of installing the platform 32 will be described with reference to FIGS. 8-12. The method will generally be described with respect to a retrofit installation, however, it is understood that the system and method may also be utilized in new installations as described below.

Figure 8:
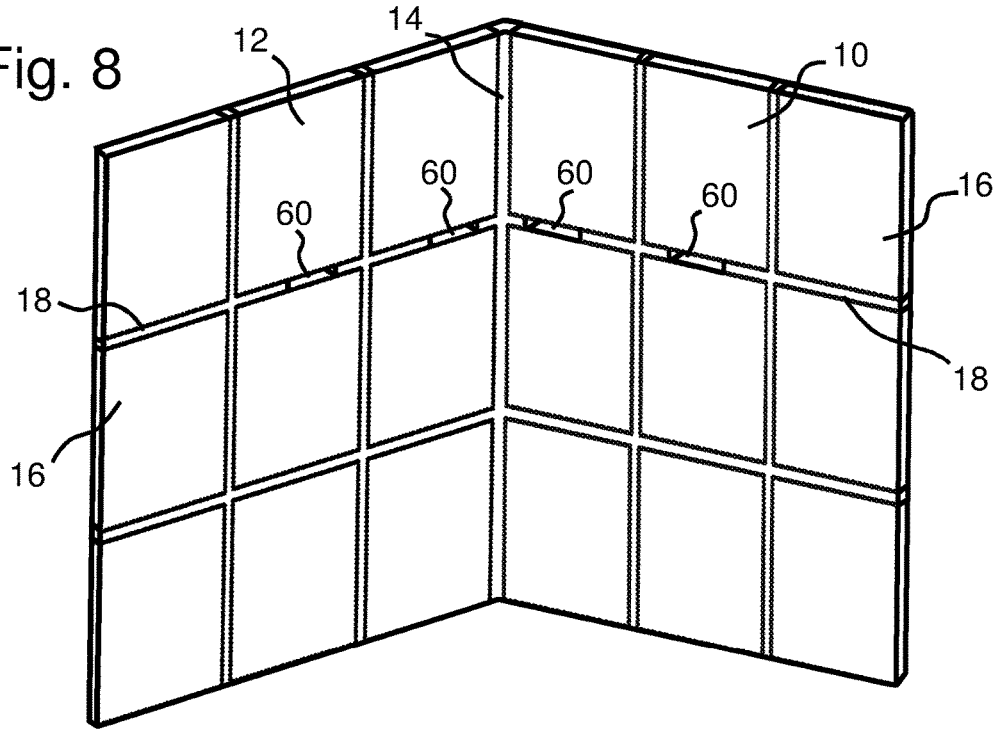
FIGS. 8-12 are schematic views illustrating a method of mounting a platform in accordance with an embodiment of the disclosure.
Figure 9:
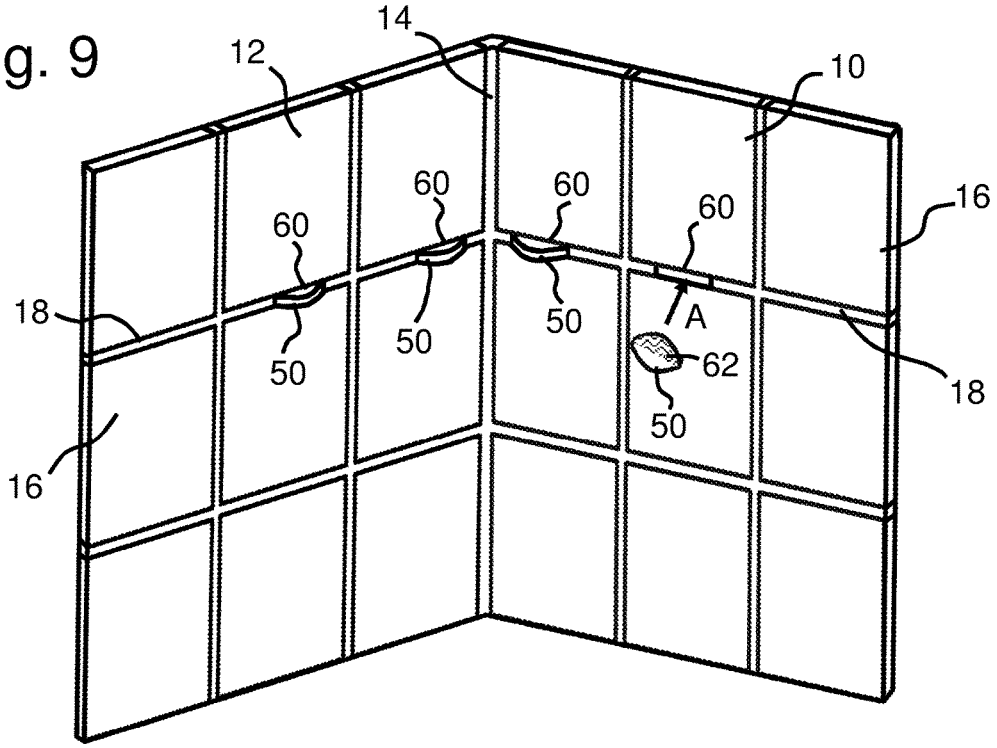

As a first step in a retrofit installation, a horizontal grout joint 18 is selected and a plurality of receiving slots 60 are formed within the joint 18 by removing the grout, as shown in FIG. 8. The grout may be removed, for example, using a handheld grout saw, an oscillating tool with a grout removing blade, or a grinder with a thin kerf blade. Other methods may also be utilized. Alternatively, if the platform is to be mounted on a non-tiled surface or in an area of a tiled wall other than a joint, the slots 60 may be formed where desired, for example, using a saw or grinder with a blade made for cutting tile/stone.

Once the slots 60 are formed, an anchoring plate 50 is secured in each slot 60, for example, utilizing an adhesive 62 applied to one half of the plate 50. The plates 50 are inserted into the slots 60 as illustrated by arrow A in FIG. 9. For a new installation, it is not necessary to form the slots within the joint. Instead, the anchoring plates 50 may simply be secured within the joint 18 as the tile 16 is installed, with the joint serving as the slot. Use of the platform system 30 in a new installation eliminates the need to cut the tile 16 around the platform 32. Upon installation, a portion of each plate 50 extends from the surface of the respective wall 10, 12.

The number of anchoring plates 50 may be selected based on the size of the platform 32. For example, for a 10 inch corner shelf, two plates 50 may be utilized along each anchoring edge 34, 36; however, for a 24 inch corner seat, five plates 50 may be utilized along each anchoring edge 34, 36.

Figure 10:
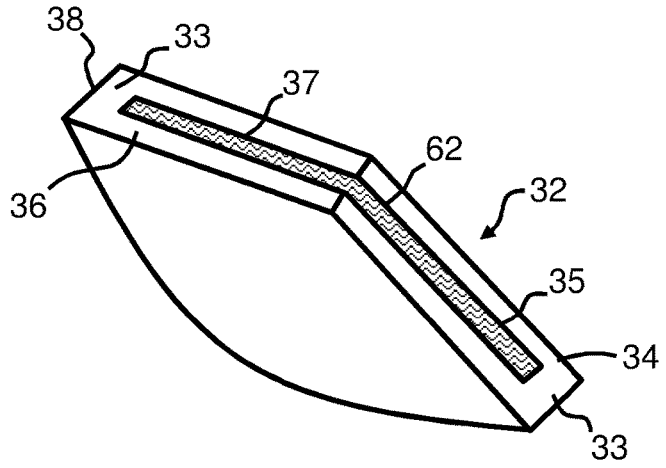
Figure 11:
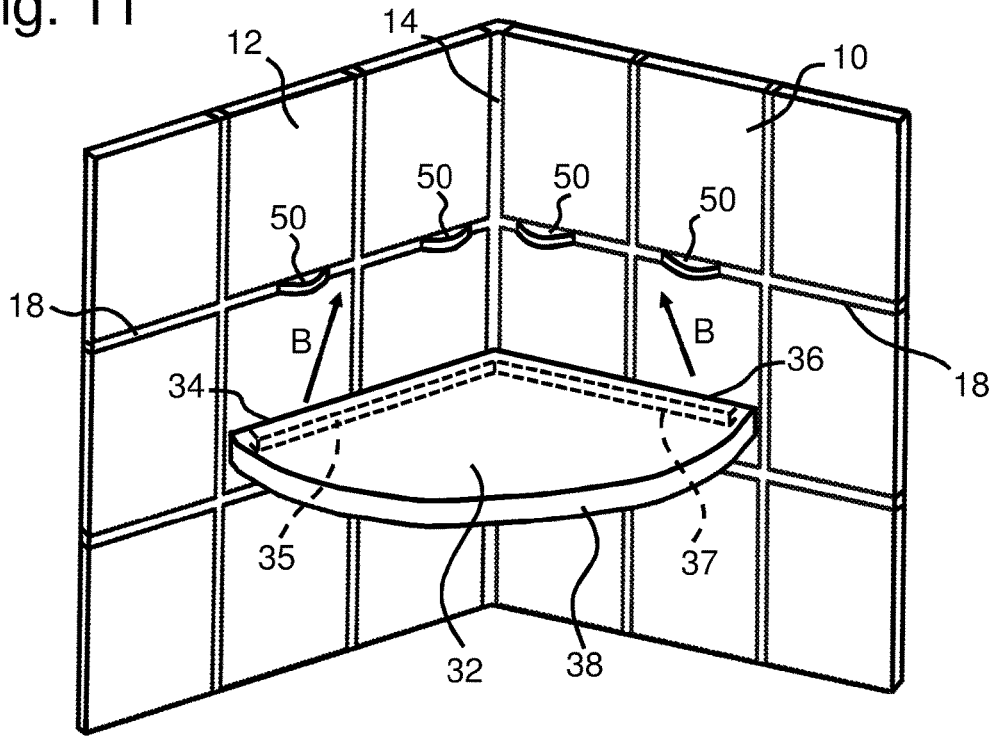
Figure 12:
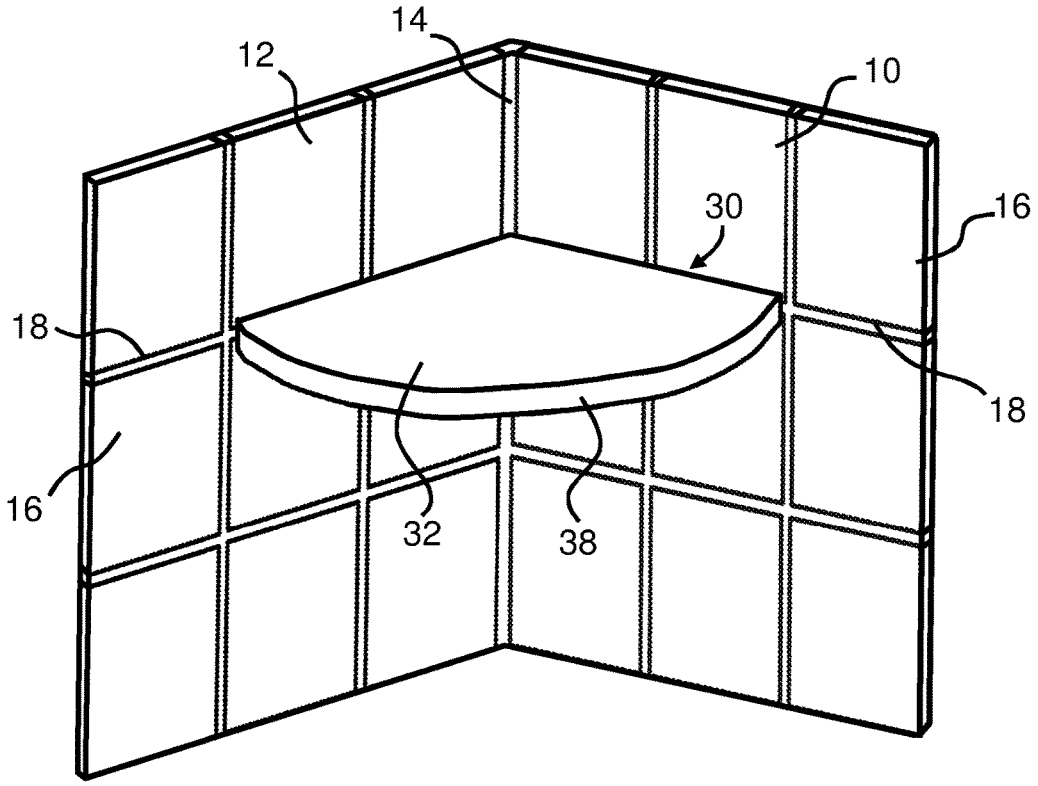

Once the anchoring plates 50 are secured, adhesive 62 or the like is applied in the channels 35, 37 as illustrated in FIG. 10. Alternatively or additionally, adhesive may be applied to the portions of the anchoring plates 50 extending from the wall surface. The platform 32 is then moved horizontally into the corner 14 as indicated by the arrows B in FIG. 11. As the platform 32 is moved into the corner 14, the anchoring plates 50 are received in the respective channels 35, 37. Once the adhesive has cured or otherwise dried, the platform 32 is reliably secured in the corner 14, as illustrated in FIG. 12. Once secured, the channels 35, 37 and the anchoring plates 50 are not visible, however, the anchoring plates 50 interact with the channels 35, 37 and the tiles 16 and/or surface to withstand the sheer and torsional forces applied to the platform 32. Caulk or the like (not shown) may be applied about the anchoring edges 34, 36 of the platform 32.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A method of securing a platform relative to a pair of surfaces, the method comprising:

forming at least two spaced-apart slots in each of a first surface and a second surface, wherein the first surface and the second surface are disposed at a right angle to one another;

securing a first half of an anchoring plate in each slot in both the first surface and the second surface such that at least a portion of each anchoring plate extends from the first surface and second surface;

sliding a first channel formed within a first anchoring edge of the platform over a second half of the anchoring plate extending from the first surface;

sliding a second channel formed within a second anchoring edge of the platform over a second half of the anchoring plate extending from the second surface; and securing the second half of the anchoring plates within respective first and second channels, wherein each of the first surface and the second surface is a tiled surface, and wherein the step of forming the at least two spaced-apart slots in each of the first surface and the second surface includes one or more of cutting the spaced-apart slots into each respective tiled surface and cutting the spaced apart slots into a joint between tiles of each respective tiled surface.

2. The method according to claim 1 wherein each of the first surface and the second surface is in a bathroom shower.

3. The method according to claim 1 wherein the step of securing the first half of the anchoring plates in each slot in both the first surface and the second surface comprises applying an adhesive to the first half of each anchoring plate.

4. The method according to claim 1 wherein the step of securing the second half of the anchoring plates within the respective first and second channels comprising applying an adhesive to one or more of the respective first and second channels and the second half of each anchoring plate.

* * * * *